US005154798A

United States Patent [19]

Melacini et al.

[11] Patent Number: 5,154,798

[45] Date of Patent: Oct. 13, 1992

[54] FELTS AND NONWOVEN FABRICS BASED ON POLYESTER FIBERS AND GLASS FIBERS AND PROCESS FOR OBTAINING SAME

[75] Inventors: Paolo Melacini, Venezia-Mestre; Giovanni Pieri, Novara, both of Italy

[73] Assignee: Montefibre S.P.A., Milan, Italy

[21] Appl. No.: 707,286

[22] Filed: May 28, 1991

Related U.S. Application Data

[63] Continuation of Ser. No. 485,845, Feb. 21, 1990, abandoned, which is a continuation of Ser. No. 218,572, Jul. 12, 1988, abandoned.

[30] Foreign Application Priority Data

Jul. 16, 1987 [IT] Italy ..... 21319 A/87

[51] Int. Cl.[5] ..... D21H 13/24

[52] U.S. Cl. ..... 162/145; 162/146; 162/207

[58] Field of Search ..... 162/145, 146, 156, 157.2, 162/157.3, 207

[56] References Cited

U.S. PATENT DOCUMENTS

| | | | |
|---|---|---|---|
| 3,489,643 | 1/1970 | Hoffman | 162/146 |
| 3,622,445 | 11/1971 | Heidweiller | 162/156 |
| 4,234,379 | 11/1980 | Conway et al. | 162/145 |
| 4,247,364 | 1/1981 | Culp | 162/146 |
| 4,318,774 | 3/1982 | Powell et al. | 162/146 |

FOREIGN PATENT DOCUMENTS

| | | | |
|---|---|---|---|
| 572962 | 10/1945 | United Kingdom | 162/146 |
| 703394 | 2/1954 | United Kingdom | 162/145 |

OTHER PUBLICATIONS

Battista, *Synthetic Fibers in Papermaking*, Interscience Publishers, (1964) p. 85.

*Primary Examiner*—Peter Chin

*Attorney, Agent, or Firm*—Morgan & Finnegan

[57] ABSTRACT

Felts and non-woven fabrics comprising glass fibers and unstretched polyester fibers having a titer higher than 3 dtex, a break elongation higher than 100%, a modulus lower than 200 g/tex, a crystallinity lower than 20%, and a toughness lower than 20 g/tex.

12 Claims, No Drawings

FELTS AND NONWOVEN FABRICS BASED ON POLYESTER FIBERS AND GLASS FIBERS AND PROCESS FOR OBTAINING SAME

This is a continuation of co-pending application Ser. No. 485,845, filed on Feb. 21, 1990 which is a continuation of application Ser. No. 218,572, filed Jul. 12, 1988 abandoned.

DESCRIPTION OF THE INVENTION

This invention relates to felts and non-woven fabrics based on blends of polyester and glass fibers which can be transformed into manufactured articles of different kinds, and to a process for obtaining them according to technologies known in the paper industry.

The preparation of felts and of non-woven fabrics consisting of blends of thermoplastic and glass fibers is well known in the art. It is also known that these felts and non-woven fabrics can be obtained by known methods, either by a "dry" process involving the use of carding machines (or of garnet machines or of air-forming machines) or by a "wet" process involving the use of the usual equipment employed in paper manufacture. This last method shows undoubted advantages as to cheapness as well as to the physical properties of the thus-obtained products and therefore is the preferred method.

The activities in this field have been and are still focused on the analysis of fibrous materials, which may allow one to obtain fibrous structures endowed with sufficient cohesion as to make them utilizable in subsequent transformation or processing operations, using techniques common to paper preparation.

U.S. Pat. No. 4,431,696 describes the preparation, by the usual methods, of self-supporting sheets or felts starting from blends of glass fibers with fibrils or fibrides of olefinic polymers having a surface area higher than 1 $m^2/g$. In that case, the self-supporting properties of the sheets come from the particular polyolefinic fibers used by the patentee. Their morphology, which is very irregular, allows one to create a physical bond with the glass fibers, sufficient to obtain a remarkable structural completeness.

In Italian Patent No. 1,161,880, following the common methods used for paper, coherent veils of glass fibers are prepared using blends of said fibers with conventional thermoplastic polymers. These last, after the drying of the veil, are allowed to melt, thus obtaining satisfactory adhesion among the glass fibers and the formation of a stable and coherent structure.

In accordance with the present invention, it has now been discovered that it is possible to prepare, following the methods common to the manufacture of felts, veils, or non-woven fabrics of glass fibers and thermoplastic fibers showing a stable and coherent structure, using for the preparation of manufactured articles of different shape, if the thermoplastic fibers consist or consist essentially of unstretched or incompletely stretched polyester fibers having the following properties:

length: between 2 and 35 mm;
titer: higher than 3 dtex;
toughness: lower than 20 g/tex;
break elongation: higher than 100%;
modulus: lower than 200 g/tex; and
crystallinity: lower than 20%.

Polyester fibers used for the preparation of the felts or non-woven fabrics of the present invention are prepared by the melt-spinning of a polyester containing at least 90% by moles of polyethyleneterephthalate.

A polyethyleneterephthalate having an intrinsic viscosity between 0.5 and 0.7, as measured in o-chlorophenol at 35° C. by means of a Ubbelohde viscometer, and a density between 1.3 and 1.5 $g/cm^3$ is particularly preferred.

Polyester fibers may contain small amounts of well-known dulling or delustering agents, antistatic agents, antioxidants, optical brighteners, etc., generally used in the preparation of conventional polyester fibers.

The polyethyleneterephthalate fibers having a length between 4 and 10 mm, a titer between 5 and 15 dtex, a break elongation between 300 and 700%, a modulus between 100 and 150 g/tex, and a crystallinity between 1 and 10% are particularly preferred for the preparation of felts or non-woven fabrics according to the present invention.

The glass fibers, in particular those of E glass, used in the present invention, are well known in the literature and are marketed for instance by VITROFIL S.p.A., by Owens-Corning Fiberglass, and by the PPG Company. They have a diameter between 5 and 15, and in particular between 10 and 13 micrometers, and a length between 2 and 25 mm. These glass fibers may be coated with a finish, such as for instance an epoxy resin, or in general by finishes suitable for polyester resins.

For the preparation of the felts and non-woven fabrics of the present invention, one may use blends containing from 10 to 90% by weight of glass fibers, and correspondingly to a 90–10% by weight of polyester fibers. Blends containing from 50 to 80% by weight of polyester fibers and correspondingly from 50 to 80% by weight of glass fibers are preferred.

The manufacture of the above-mentioned felts, veils and non-woven fabrics is performed by preparation methods commonly used for paper, which generally consist or consist essentially in placing the fibers in an aqueous medium, and thereafter in forming the veil, the felt or the non-woven fabric by deposition of the fibrous dispersion on a filtering baffle, and finally in drying it.

In particular, the process for obtaining felts, veils or non-woven fabrics based on blends of polyester and glass fibers, comprises the following successive operations or steps:

(a) preparation of an aqueous dispersion of a homogeneous blend of fibers comprising, based on 100 parts by weight, from 90 to 10, and preferably from 50 to 20, parts by weight of glass fibers and from 10 to 90, and preferably from 50 to 80, parts by weight of polyester fibers having the above-mentioned properties;

(b) formation of a veil or felt of said blend of fibers by settling the fibrous dispersion onto a filtering baffle, favoring if necessary or desired, the elimination of the excess liquid from the veil or felt by sucking or by application of vacuum; and (c) drying of the thus-obtained veil or felt.

The preparation described under (a) may be performed in vats or hollanders under agitation until the fiber concentration is about 0.5–2% by weight, preferably in the presence of dispersing agents or surfactants, in order to secure a good dispersion of the fibers. The presence of these agents in the bath is not necessary when the fibers have been previously treated for this purpose.

The formation of the veil or felt described under (b) may be easily done by means of well-known types of machines used in the paper industry; in particular, by means of a Rotiformer or by means of raked boards, which as known are suitable for the manufacture of sheets starting from a wet mixture containing synthetic fibers. However, other types of machines may be used for this operation, such as for instance Fourdrinier machines either cylindrical or sloping.

The drying operation described under (c) is performed under an air stream or, better yet, under a stream of inert gas heated at 50°-150° C., but it may also be performed by other means, for instance by means of heated rolls.

Fibers of thermoplastic polymers different from polyester may be present in the dispersions in amounts up to 10 parts by weight based on 100 parts of the fibrous mixture.

Felts, veils and non-woven fabrics according to this invention are particularly suitable for the manufacture of molded articles by means of the known "flow-molding" technique for the preparation of molded manufactured articles from reinforced thermoplastic sheets. According to this technique, the felt is heated in an infrared over at 300° C., by hot nitrogen circulation, so that the polyester resin melts and impregnates the glass fibers.

The "molten felt" is then transferred into the mold of a vertical press and is molded by total filling of the hole.

EXAMPLES

The following examples are given in order still better to illustrate the present invention but without limiting its scope in any way.

EXAMPLE 1

In the mixing box connected to a Rotiformer unit equipped with 2540 mm of board, a 1% aqueous dispersion of a blend of fibers was prepared consisting of:

30% by weight of glass fibers having a length of 6 mm;

70% by weight of uncrimped polyethyleneterephthalate fibers having the following properties:

| | |
|---|---|
| Titer: | 12.3 d/tex |
| Toughness | 12.5 g/tex |
| Length | 6.5 mm |
| Elongation: | 618.6% |
| Modulus: | 145 |
| Crystallinity: | 3.8% |

These polyester fibers were obtained by the melt-spinning of polyehtyleneterephthalate having a density of 1.34 g/cm$^3$ and an intrinsic viscosity of 0.625, measured in o-chlorophenol at 35° C. by means of a viscometer of the Ubbelohde type.

The polyethyleneterephthalate fibers were collected in a tow of 100 ktex, which was then cut in chops of 6.5 mm by means of a slash cutter working at 150 strokes/-min.

The fibrous dispersion was then fed to the Rotiformer unit with a flow of about 27,000 liters/min. The Rotiformer unit was working in the presence of suction boxes inside the drum, completely soaked (or immersed) in the sloping zone where said formation occurred.

Thus a felt was obtained of 2 kg/m$^2$, and having a thickness of 5 mm, which was dried by passage through an oven through which was circulated nitrogen at 90° C.

The thus-obtained felt had the following properties:

Longitudinal tensile strength: 20 deca N/5 cm

Transversal tensile strength: 16 deca N/5 cm

Determinations were carried out on 10 series of 4 specimens each, having a size of 5×30 cm, drawn from the production lines every 20 minutes, transversely and longitudinally with respect to the direction of production, using a dynamometer whose clamps moved away at a speed or 10 cm/minute.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims. The above references are hereby incorporated by reference.

What is claimed is:

1. In a process for the preparation of felts, veils or non-woven fabrics endowed with stable and coherent structure, comprising the following successive steps:

(a) preparing an aqueous dispersion of a homogenous blend of fibers consisting essentially of a blend of from 10 to 90% by weight of glass fibers and from 90 to 10% by weight of unstretched or not wholly stretched polyester fibers containing at least 90 mole percent of polyethyleneterephthalate and having a length between 2 and 25 mm, a titer greater than 3 d/tex, a toughness lower than 20 g/tex, a break elongation greater than 100%, and a modulus lower than 200 g/tex;

(b) forming a veil, felt or non-woven fabric of said blend of fibers by introducing the fibrous aqueous dispersion onto a filtering baffle, and removing excess liquid from the veil, felt or non-woven fabric by suction or by using vacuum; and (c) heat-treating the thus-obtained veil, felt, or non-woven fabric, wherein the improvements consist of the use of polyester fibers having a crystallinity lower than 20% and the heat-treatment of step (c) being carried out under a stream of inert gas heated at 50 to 150° C.

2. Process according to claim 1, wherein said polyester fibers have a crystallinity between 1 and 10%.

3. Process according to claim 1 wherein the blend contains from 50 to 80% by weight of polyester fibers and correspondingly from 50 to 20% by weight of glass fibers.

4. Process according to claim 2 wherein the blend contains from 50 to 80% by weight of polyester fibers and correspondingly from 50 to 20 by weight of glass fibers.

5. Process according to claim 1 wherein the polyester is polyethyleneterephthalate having an intrinsic viscosity between 0.5 and 0.7, measured in o-chlorophenol at 35° C. by means of an Ubbelohde viscometer, and a density between 1.3 and 1.5 g/cm$^3$.

6. Process according to claim 2 wherein the polyester is polyethyleneterephthalate having an intrinsic viscosity between 0.5 and 0.7, measured in o-chlorophenol at 35° C. by means of an Ubbelohde viscometer, and a density between 1.3 and 1.5 g/cm$^3$.

7. A process for the preparation of felts, veils or non-woven fabrics endowed with stable and coherent structure, comprising the following successive steps:

(a) preparing an aqueous dispersion of a homogenous blend of fibers consisting essentially of a blend of from 10 to 90% by weight of glass fibers and from 90 to 10% by weight of unstretched or not wholly stretched polyester fibers containing at least 90 mole percent of polyethyleneterephthalate and having a length between 2 and 25 mm, a titer greater than 3 d/tex, a toughness lower than 20 g/tex, a break elongation greater than 100%, a modulus lower than 200 g/tex, and a crystallinity lower than 20%.

(b) forming a veil, felt or non-woven fabric of said blend of fibers by introducing the fibrous aqueous dispersion onto a filtering baffle, and removing excess liquid from the veil, felt or non-woven fabric by suction or by using vacuum; and (c) heat-treating the thus-obtained veil, felt or non-woven fabric under a stream of inert gas at 50° to 150° C.

8. Process according to claim 7, wherein said polyester fibers have a crystallinity between 1 and 10%.

9. Process according to claim 7, wherein the blend contains from 50 to 80% by weight of polyester fibers and correspondingly from 50 to 20% by weight of glass fibers.

10. Process according to claim 8, wherein the blend contains from 50 to 80% by weight of polyester fibers and correspondingly from 50 to 20% by weight of glass fibers.

11. Process according to claim 7, wherein the polyester is polyethyleneterephthalate having an intrinsic viscosity between 0.5 and 0.7, measured in o-chlorophenol at 35° C. by means of an Ubbelohde viscometer, and a density between 1.3 and 1.5 g/cm$^3$.

12. Process according to claim 8, wherein the polyester is polyethyleneterephthalate having an intrinsic viscosity between 0.5 and 0.7, measured in o-chlorophenol at 35° C. by means of an Ubbelohde viscometer, and a density between 1.3 and 1.5 g/cm$^3$.

* * * * *